United States Patent [19]

Kuhlen

[11] Patent Number: 4,917,069

[45] Date of Patent: Apr. 17, 1990

[54] FUEL PUMP MOUNTED ON AN ENGINE WITH REDUCED HEAT TRANSMISSION THEREFROM

[75] Inventor: Ernst Kuhlen, Willich, Fed. Rep. of Germany

[73] Assignee: Pierburg GmbH, Neuss, Fed. Rep. of Germany

[21] Appl. No.: 307,419

[22] Filed: Feb. 6, 1989

[30] Foreign Application Priority Data

Jun. 29, 1988 [DE] Fed. Rep. of Germany ..... 3821888

[51] Int. Cl.[4] ..... F02M 39/00

[52] U.S. Cl. ..... 123/509; 123/198 C; 417/380; 418/179

[58] Field of Search ..... 123/509, 198 C, 508, 123/507, 495; 417/380, 499; 418/179

[56] References Cited

U.S. PATENT DOCUMENTS

| | | | |
|---|---|---|---|
| 2,308,746 | 1/1943 | Flint | 123/198 C |
| 4,306,680 | 12/1981 | Smith | 417/380 |
| 4,403,586 | 9/1989 | Taniguchi | 123/509 |
| 4,430,977 | 2/1984 | Shimada | 123/509 |
| 4,530,335 | 7/1985 | Torizuka | 123/495 |
| 4,539,964 | 9/1985 | Djordjevic | 123/198 C |
| 4,571,161 | 2/1986 | Leblanc | 123/509 |
| 4,747,762 | 5/1988 | Fairbairn | 418/179 |
| 4,760,831 | 8/1988 | Altdorf | 123/495 |

FOREIGN PATENT DOCUMENTS

| | | | |
|---|---|---|---|
| 547612 | 10/1957 | Canada | 123/509 |
| 2213806 | 9/1972 | Fed. Rep. of Germany | 123/509 |

*Primary Examiner*—Carl Stuart Miller

*Attorney, Agent, or Firm*—Ladas & Parry

[57] ABSTRACT

A fuel pump is mounted on an engine to reduce heat transmission therefrom by a construction in which the housing of the fuel pump is formed at its base with an annular flange with a relatively small diameter which rests on the engine around on opening therein for the operating rod of the fuel pump. The housing of the pump is secured to the engine by a holder which has a shelf bearing on the flange and which includes a depending perimetral flange secured on the engine by a bolt at the distal end of the holder.

12 Claims, 1 Drawing Sheet

FUEL PUMP MOUNTED ON AN ENGINE WITH REDUCED HEAT TRANSMISSION THEREFROM

FIELD OF THE INVENTION

The present invention relates to a fuel pump, particularly a diaphragm pump, which is driven by an internal combustion engine and can be attached directly thereto, the working chamber of the pump being filled through a suction valve and emptied through a pressure valve.

DESCRIPTION OF PRIOR ART

These fuel pumps are characterized by their compact size and therefore they are frequently used for supplying fuel to the carburetors of internal combustion engines which are installed in motor vehicles.

In this regard, the fuel pump is attached directly to the engine block and is thus subject to the variable temperature of the engine dependent on the state of operation of the internal combustion engine. Considerable differences in temperature occur which are promoted by the small engine compartments of modern streamlined vehicle bodies.

As a result of an increase in the low-boiling fractions of fuel which has taken place in recent times, drive irregularities during hot idling operation and difficulty in hot starting are common due to fuel vaporization.

In DE-OS No. 20 00 213, two general types of distrubances are disclosed. One is the formation of a vapor lock within the pump and the other is the formation of a vapor lock in the lines connecting the pump to the mixtureformer (carburetor or fuel injector) of the internal combustion engine.

In order to overcome these deficiencies DE-OS No. 20 00 213 proposes providing a diaphragm which is acted on by the pressure in said line and which throttles the cross-sectional passage of the line leading to the mixture-former upon the occurrence of an increase in pressure due to the formation of a vapor lock and, at the same time, a return channel from this line is opened to the intake line. A similar proposal is found in DE-OS No. 25 59 157, which regulates the pressure present in the line between the fuel pump and the mixture-former and, independentaly thereof, controls a return channel by which fuel and possibly also fuel vapor can flow back into the fuel tank.

It is furthermore known to provide, between the fuel pump and the mixture-former, a separate gas separator which can discharge a large amount of fuel vapor to the fuel tank via an open ball-check valve and a return line and, after the discharge of the fuel vapor, the gas separator permits only a small amount of liquid fuel to flow off via a bypass as the ball valve closes the return line.

All of these means are expensive, require additional installation space and connecting lines, and cannot be used in all cases.

SUMMARY OF THE INVENTION

An object of the present invention is to provide an inexpensive fuel pump of this type by which error-free operation is possible.

A further object of the invention is to provide a fuel pump construction and mounting by which reduced heat transmission from the engine to the fuel pump will be obtained.

The above and further objects of the invention are achieved by forming the base of the housing of the fuel pump as an annular flange which bears against the engine around an opening in the engine for the passage of an operating rod, the flange being relatively narrow in width as compared to conventional pumps; the housing is held on the engine by a holder which is fitted on the annular flange and is secured to the engine.

In further accordance with the invention, the holder is constructed as a claw including a perimetral flange which bears on the engine and a shelf on the perimetral flange which rests on the flange of the pump housing. At its distal end the claw is secured to the engine by a bolt.

In further accordance with the invention, the base of the pump housing has a groove in which the shelf is engaged and the flange of the pump housing has an upward projection which extends into an aperture in the shelf so that the claw is lockably engaged with the pump housing.

Conventional fuel pumps become extremely heated due to thermal conduction and radiation during hot idling operation and upon hot starting of the internal combustion engine, so that fuel fed from the fuel tank is already vaporized upon entrance into the fuel pump and a lengthy period of time elapses without delivery of fuel until the commencement of delivery of liquid, as a result of which the starting of the engine or the application of load thereto from idling is difficult if not impossible.

These deficiencies no longer occur with the fuel pump of the invention, since the conduction of heat is considerably reduced by reduction in the size of the contact surface between the base of the fuel pump housing and the engine housing. Furthermore, due to a reduced mass of material, there is a considerable reduction in the thermal capacitance.

According to a feature of the invention, the claw is made of relatively inexpensive material as it need not be high in strength. The holder is held on the fuel pump in secured manner so as not to be easily separable therefrom which permits an advantageous mounting and installation of the fuel pump and a corresponding saving in expense.

The holder advantageously includes an interior support in the region between the base of the fuel pump housing and the mounting bolt whereby the clamping force acting on the flange is reduced.

Additionally, the housing of the fuel pump can be made from a heat-resistant, heat-insulating plastic material which further improves the above-described properties of the fuel pump and any possible loss in seating of the base of the fuel pump housing over time and temperature is elastically compensated by the special construction of the holder. By virtue of the construction according to the invention, the fuel pump will no longer be as intensely heated, so that short starting times, a good assumption of heated, so that short starting times, a good assumption of load and error-free hot operation is obtained even with the further reduction of the size of the engine compartment.

BRIEF DESCRIPTION OF THE FIGURES OF THE DRAWING

One embodiment of the invention is shown in the drawing in which.

DETAILED DESCRIPTION OF A PREFERRED EMBODIMENT

Figure 1:
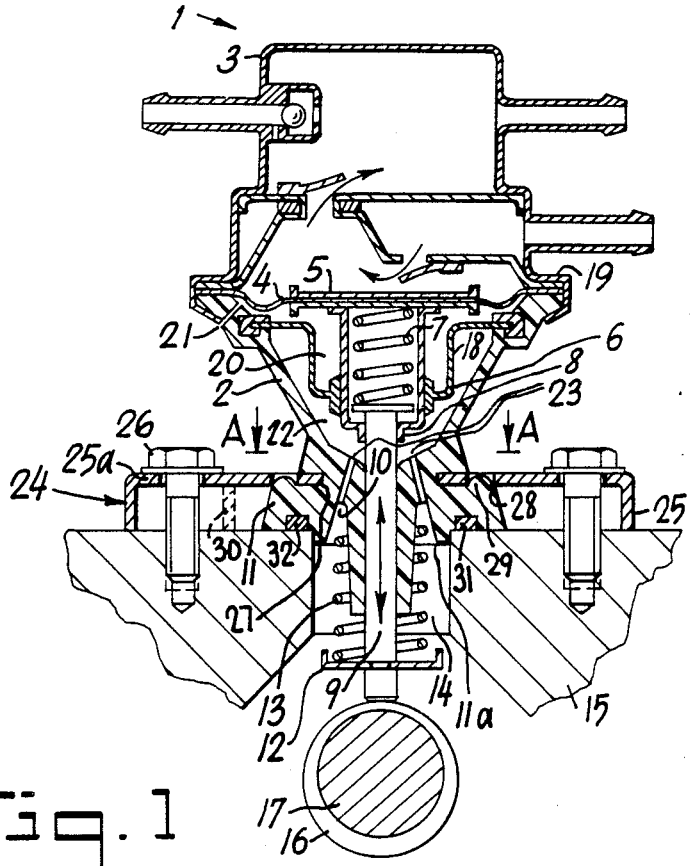
FIG. 1 is a diagrammatic illustration, partly in section of a fuel pump, and, according to the invention

The fuel pump 1 is a diaphragm pump and comprises a housing 2, a cover 3 and a diaphragm 4 clamped between housing 2 and cover 3. Coupled to the diaphragm 4 by a diaphragm plate 5 is a coupling cap 6 having a diaphragm spring 7. The diaphragm spring 7 has one end which bears against the diaphragm 4 and an opposite end which bears against a ram 9 which extends through a bore 8 into the coupling cap 6. A ram spring 13 is seated at one end in a recess 10 in a base 11 of the housing 2 and at the other end, the spring 13 bears against a spring plate 12. The ram 9 passes through an opening 14 in an engine housing 15 and contacts a cam disc 16 which is arranged on a shaft 17 driven by the engine.

The base 11 of the housing of the fuel pump includes an inner annular lip **11*a* which is seated in opening 14** to facilitate positioning of the fuel pump on the engine.

A chamber 20 is formed between the diaphragm 4 and a sealing diaphragm 18 whose outer edge is secured by a holding ring 19 to the housing 2 and whose inner edge is secured to the coupling cap 6. The chamber 20 is vented to the atmosphere by a bore 21 in housing 2.

A chamber 22 is formed below the sealing diaphragm 18 and communicates with the opening 14 in the engine housing 15 by holes 23 in housing 2.

The base 11 of the housing of the fuel pump is formed as a relatively small annular flange having minimal contact with the engine housing 15 in order to minimize heat transfer from the engine to the housing of the fuel pump.

Figure 2:
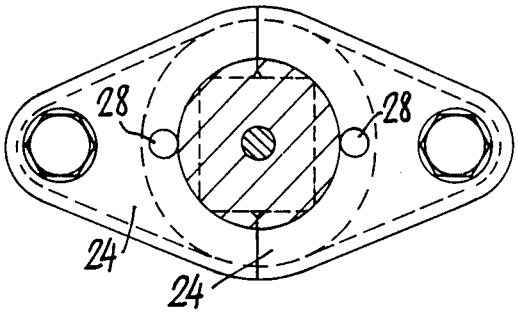
FIG. 2 is a section taken along line A–A.
Figure 1:
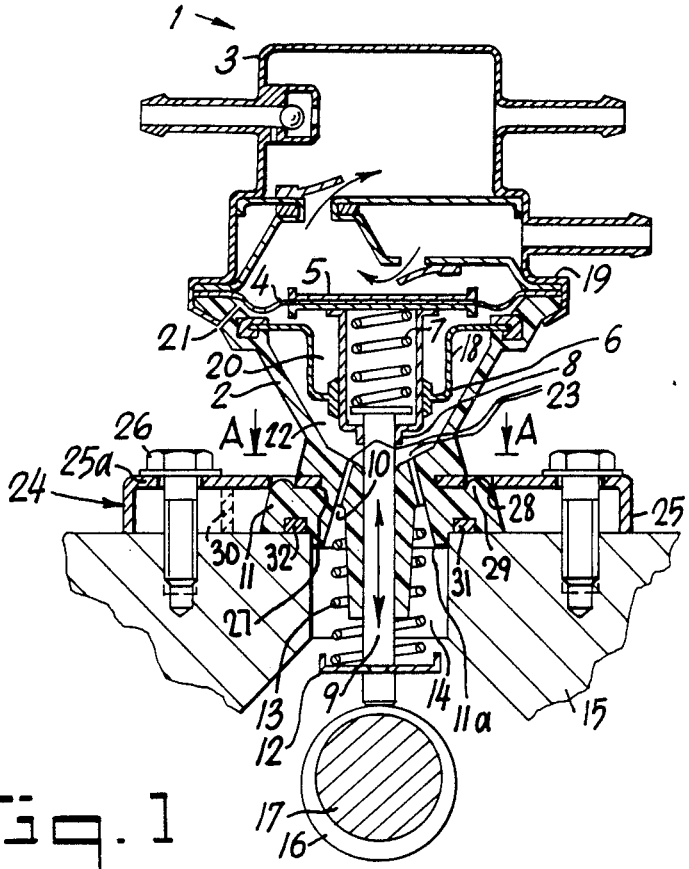
Figure 2:
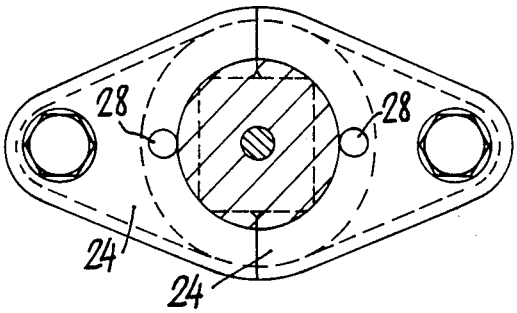

The fuel pump is mounted on the engine by a holder means which also has minimal contact with the engine housing 15. The holder means comprises a claw having two independent claw portions 24, each having a perimetral downwardly bent flange 25 bearing against the engine housing 15 and a shelf **25*a* raised above the engine housing which engages on the upper surface of the annular flange 11. Each claw portion is secured to the engine housing by a bolt 26 at its distal end and the other end of the shelf 25*a* rests on flange 11 and is inserted into a groove 27 in the housing 2. The claw portions 24 taper in narrowing fashion from the base 11 towards the bolts 26 (see FIG. 2). The claw portions 24 are provided with apertures 28 into which are fitted projections 29 on the upper surface of flange 11 in order to securely position and hold the claw portions on the flange 11. In this regard, the apertures 28 and projections 29 are so positioned with respect to the groove 27 that when the projections 29 are engaged in the apertures 28 with the shelf 25*a* seated on the groove 27, the claw portion is lockably secured to the base 11** and is not readily separable therefrom.

By virtue of the construction of the claw portions and their engagement with the base 11 of the fuel pump housing, the base 11 can be substantially reduced in size as compared to conventional constructions and the contact of the holder can be limited to the contact of the lower edges of flanges 25 with the engine housing. This substantially reduces heat transfer from the engine to the fuel pump.

It is also possible to form the holder as a one piece claw and to secure it to the engine housing 15 at one or both sides.

An O-ring 32 is arranged in a groove 31 on the flange 11 to serve as an oil seal.

In an alternate embodiment, each of the claw portions 24 is provided with an interior support 30 in the region between base 11 and bolt 26.

The feed of fuel through the pump is diagrammatically illustrated by the arrows in FIG. 1, and as seen therein, the fuel enters a working chamber of the pump through a suction valve and is discharged from the working chamber through a pressure valve. The operation of the fuel pump is conventional and does not form any part of the present invention.

Although the invention has been described in relation to a specific embodiment thereof, it will become apparent to those skilled in the art that numerous modifications and variations can be made within the scope and spirit of the invention as defined in the attached claims.

What is claimed is:

1. A fuel pump driven by an internal combustion engine and mounted on the engine at an opening therein, said fuel pump comprising a housing including a base, said base comprising an annular flange bearing on the engine in surrounding relation to said opening therein, and a holder means engaged on said annular flange for securing the base of the housing to the engine, said holder means comprising a claw and a bolt securing said claw to the engine, said base having a groove into which said claw is engaged, said base including a projection outside said groove, said claw having an aperture in which said projection is engaged when said claw is engaged in said groove.

2. A fuel pump as claimed in claim 1 wherein said base further comprises a portion projecting into said opening in the engine.

3. A fuel pump as claimed in claim 1 wherein said claw includes a perimetral flange which bears on said engine, and a shelf on the perimetral flange disposed above the engine, to define a space therebetween, said perimetral flange depending from said shelf at the outer periphery thereof and having a lower end bearing against the engine, said shelf having an end engaged in said groove and resting on the flange of the pump housing.

4. A fuel pump as claimed in claim 3 wherein said claw includes two opposed claw portions each having a respective said shelf engaged in said groove in said base.

5. A fuel pump as claimed in claim 4 wherein each claw portion is secured to the engine by a respective said bolt.

6. A fuel pump as claimed in claim 5 wherein each said claw portion has an aperture in the respective shelf, said base including a projection engaging each aperture.

7. A fuel pump as claimed in claim 1 wherein said claw includes an interior support between said bolt and said base for bearing against said engine.

8. A fuel pump as claimed in claim 1 wherein said housing is made of plastic material.

9. A fuel pump as claimed in claim 1 comprising seal means between said base and the engine around the opening in the engine.

10. A fuel pump as claimed in claim 1 wherein said claw narrows from said base towards said bolt.

11. A fuel pump as claimed in claim 1 comprising a diaphragm secured in said housing.

12. A fuel pump as claimed in claim 3 wherein said bolt is attached to said claw in spaced relation from said base.

* * * * *